US005255820A

United States Patent [19]

Thomas

[11] Patent Number: 5,255,820

[45] Date of Patent: Oct. 26, 1993

[54] APPARATUS FOR DILUTION OF LIQUID PRODUCTS

[75] Inventor. John E. Thomas, River Falls, Wis.

[73] Assignee: Ecolab Inc., Saint Paul, Minn.

[21] Appl. No.: 690,505

[22] Filed: Apr. 24, 1991

[51] Int. Cl.[5] ..... B05B 7/30

[52] U.S. Cl. ..... 222/1; 222/25; 222/630

[58] Field of Search ..... 222/1, 25, 95, 129.2, 222/129.3, 132, 134, 145, 147, 395, 630

[56] References Cited

U.S. PATENT DOCUMENTS

| | | | |
|---|---|---|---|
| 2,716,507 | 8/1955 | Graves | 222/129.2 |
| 2,811,389 | 10/1957 | Fischer | 222/630 X |
| 3,168,967 | 2/1965 | Giampa | 222/129.1 |
| 4,254,805 | 3/1991 | Reeder | 141/59 |
| 4,697,610 | 10/1987 | Bricker et al. | 137/3 |
| 4,750,645 | 6/1988 | Wilson et al. | 222/129.2 X |
| 4,753,370 | 6/1988 | Rudick | 222/105 |
| 5,033,649 | 7/1991 | Copeland et al. | 222/132 |
| 5,037,003 | 8/1991 | Bally et al. | 222/129.2 |
| 5,042,523 | 8/1991 | Robertson | 137/271 |
| 5,060,825 | 10/1991 | Palmer et al. | 222/25 |

FOREIGN PATENT DOCUMENTS

| | | |
|---|---|---|
| 0325335 | 7/1989 | European Pat. Off. . |
| 2150427 | 8/1973 | Fed. Rep. of Germany . |
| 1139021 | 6/1957 | France . |
| WO85/05092 | 11/1985 | France . |
| WO89/01316 | 10/1989 | PCT Int'l Appl. . |
| 780202 | 7/1957 | United Kingdom . |
| 2010105 | 11/1978 | United Kingdom . |

OTHER PUBLICATIONS

Exhibit A, Economics Laboratory, Inc. Control Tower II advertising brochure NO. 13554/0402/0783 Jul. 1983.

Exhibit B, Dema Engineering Company's Blend Center brochure, Bulletin No. 87003.

Exhibit C, Dema Engineering Company's Multi-Blend Center brochure Bulletin No. 89010.

Exhibit D, Dema Engineering Company's Drum-Mount Proportioner, Model 162, brochure, Bulletin No. 84002.

Exhibit E, Dema Engineering Company's Demamatic Liquid Level Proportioning Controls brochures, Bulletin No. 83009.

Exhibit F, Dema Engineering Company's New Magnetically Operated Demamatic Liquid Level Proportioning Controls brochure, Bulletin No. 87-012.

Exhibit G, Ecolab Sani-Center Installation and Operation Manual 1989.

Ecolab Inc. "Cleaning Help Available" brochure, Jun. 1991.

Copy of International Search Report for Int'l Appln. No. PCT/US92/03337.

Hydro Systems Company; New Product Development: Multiple Product Selector Valve; (No publication date).

Hydro Systems Company; New Product Development: Variable Dilution Selector Valve; (No publication date).

Hydro Systems Company; New Product Development: Variable Dilution Selector Valve; (No publication date).

Hydro Systems Company; HydroFoamer Series; Copyright 1988.

Hydro Systems Company; HydroSprayer Series; Copyright 1989.

*Primary Examiner*—Andres Kashnikow
*Assistant Examiner*—Kenneth Bomberg
*Attorney, Agent, or Firm*—Merchant, Gould, Smith, Edell, Welter & Schmidt

[57] ABSTRACT

A system for diluting and dispensing concentrated liquid products is disclosed. The system's components are mounted upon a cart (12). A concentrate solution tube (14) is interconnected to a dilution assembly (61) containing an aspirator (26). A water supply assembly (69), containing a valve (73) and backflow preventer (74), is connected to the aspirator assembly (26) when dilution of the concentrated product (13) is desired. A discharge tube (68) carries the diluted product from the aspirator assembly (26) to a container (60). Also disclosed is a method for diluting and handling solutions.

15 Claims, 3 Drawing Sheets

APPARATUS FOR DILUTION OF LIQUID PRODUCTS

FIELD OF THE INVENTION

The present invention relates generally to a solution dispensing system, and more particularly to an apparatus for diluting concentrated liquid products and for dispensing the mixed solution.

BACKGROUND OF THE INVENTION

In janitorial settings which require a significant amount and number of specialized cleaning solutions, the liquid cleaning products are purchased on a concentrated basis, and then are diluted to the proper strength at the site where they will be used. This type of general system is employed by a wide variety of users, e.g., hotels, hospitals, restaurants, etc. Several dispensing systems have been developed for mixing and diluting the concentrated cleaning product. The dispensers usually feature at least some of the following components: a container for the concentrated cleaning product, a storage container for the diluted cleaning product, a method to dose concentrate into the storage container, and a water supply line to dilute the concentrate.

The dispensing systems vary widely in terms of their complexity. That is, the method of dilution may be rather simple and manual in nature, but may require a great deal of operator experience. On the other hand, the dispensing system may be quite complex, requiring several mechanical devices to dilute the concentrates. Such complex systems are often necessary where different cleaning products and different dilution ratios are utilized for different cleaning applications. These dispensing systems typically require several separate water lines, each water line corresponding to a different type of cleaning concentrate. The provision of multiple water lines increases the cost of installation. The requirement of multiple water lines also greatly limits the locations at which the dispensing system can be placed, and such a system is not portable. Accordingly, large containers such as mop buckets must be filled and taken to the point of usage by the janitorial personnel.

With one such system, a cabinet is mounted proximate the concentrated liquids and the water source. This cabinet contains a multiplicity of aspirators, backflow preventers and valves for dilution of the concentrates, the number of such devices depending upon the predetermined number established by the cabinet's manufacturer. However, such a system can be relatively complex, inflexible and expensive, especially in situations where only one concentrated liquid is utilized.

The cost of these conventional dispensing stations is relatively high, because of their complexity and because backflow preventers are generally required for each water connection by applicable plumbing codes. Pressure regulators may also be necessary to control use solution concentrations within an acceptable range. Other necessary flow control devices add to the cost of conventional dispensing systems; for example, a pick-up probe and foot valve must be employed in order to withdraw the concentrate from a rigid container.

An aspirator is employed with some dispensing systems to withdraw the concentrated cleaning solution from its container. With conventional systems, each water line requires a separate aspirator, and the aspirators are located outside the storage container in a variety of places, such as mounted to the concentrate container or mounted upon the wall adjacent to the dispensing station. These locations of the aspirator add to the complexity and space requirements of the dispensing system.

Another drawback of many conventional systems is that the dilution of the concentrate is inaccurate, resulting in a cleaning product having either too high or too low of a concentration. Many systems have no way of controlling and checking the dilution, so that inaccurate mixing by the janitorial personnel often occurs. Using too much concentrated liquid cleaner is wasteful, unnecessary, and expensive. Over-use of these products also hampers thorough rinsing and leaves messy residues. On the other hand, utilization of too little cleaning concentrate in the use solution will not clean adequately.

The present invention solves these and many other problems associated with currently available dispensing systems.

SUMMARY OF THE INVENTION

The present invention is a dilution and dispensing apparatus. The apparatus has a dilution assembly which is mounted to a plate. The dilution assembly has two inlet ports for two types of liquids, and the inlet ports are in fluid communication with a proportioning means, such as an aspirator. The proportioning means outlets to a discharge tube. Two inlet lines correspond to the two inlet ports, and both inlet lines are removably interconnected to its corresponding port. The discharge tube outlets to a suitable container, such as a mop bucket.

Preferably, one of the liquids is water, and the other liquid is a concentrated solution. In the preferred embodiment, the water is supplied by means of a water gun assembly which has a valve and backflow preventer therein. The water gun assembly attaches to the water inlet port by means of a releasable, quick connection fitting. The concentrate supply container is preferably made of a flexible material and is collapsible as the concentrate is withdrawn from the container.

According to another aspect of the invention, there is disclosed a method for storing and handling solutions, in which a water inlet line is interconnected to an aspirator assembly; a pick-up tube is interconnected to the aspirator assembly to provide a conduit for the concentrate; the water supply is activated so as to pass water and concentrate through the aspirator; and the diluted solution is discharged to an appropriate container, such as a mop bucket.

An advantage of the present invention is that it results in cost savings for the user. Because the system is simpler in design, its cost is lower than conventional dispensers. In addition, the inventive dispensing system needs only a single water line and backflow preventer which further reduces the cost of installation. Whereas the conventional dispensing systems are quite complex and expensive, the simplicity of the present invention enables it to be low in cost and affordable for even small housekeeping and food service operations. The present invention operates on water power alone, and does not require electrical connections. The various fittings, tubes, and valves are readily accessible and can be repaired easily by any necessary tightening, repair, or replacement measures.

The present invention also provides considerable flexibility by allowing the user to employ different types of cleaning products. The invention can be used for any number of chemical solutions, because the system is completely modular. The supply lines for the various concentrated cleaning products can be connected and disconnected easily, and only a single water line is needed. The modular aspect of the present invention allows the system to be appropriate for a user who has only a single concentrated product to be diluted, as well as multiple products. With the prior art systems, the number of cleaning compositions which could be dispensed is limited to the number of water lines or to a predetermined number of control valves provided in the dispenser. In contrast, the present invention can be utilized with an unlimited number of products by simply providing additional aspirator assemblies.

Another advantageous feature of the present invention is that it is economical. A single aspirator assembly may be employed by a user who has only a single concentrated product to be diluted, and the system expands to accommodate multiple aspirators where multiple concentrated products are being diluted. However, even in the latter situation, only a single backflow preventer and valve assembly is required, rather than a separate water line, backflow preventer and valve assembly for each aspirator, as was necessary with prior art systems. This feature allows a cost savings by greatly simplifying and reducing the plumbing requirements.

Another advantageous feature of the present invention is that the certain components of the dispensing system are color-coded and/or labeled to correspond with the particular cleaning product being utilized. This minimizes the chance of contamination and minimizes the likelihood that a particular cleaning product will be used at an improper dilution ratio, thus enhancing the effectiveness of the cleaning product. This feature also results in a cost savings for the user, in that waste of the cleaning product is eliminated when the proper dilution ratio is maintained. The present invention also is safe for the operator, because there is no contact with the concentrated cleaning product.

Another advantage of the present invention's dispensing system is that it is able to deliver the cleaning and sanitation products in exact use concentrations. The metering devices contained within the dispensing system assure that the proper dilution ratio is set, thereby obviating the tendency of some janitorial personnel to over-use the product. The use concentrations can be controlled to the precise number of ounces per gallon or parts per million required. This accurate dispensing eliminates product over-use, waste and spilling.

Another advantageous feature of the present invention is that it is portable enough to be set up in various locations. Because the sizes of the various components are relatively small, because only a single water line is needed, and because the system is modular, it can be set up close to the point of usage, thereby saving time and effort for the janitorial personnel. In the preferred embodiment, the apparatus is supported by a transportable cart assembly so that it is readily portable. The quick connect water assembly requires no plumbing hookup, and can be used at any sink or faucet. With the prior art systems, a plumbing hook-up was required, which restricted the location at which the system could be utilized.

For a better understanding of the invention, and of the advantages obtained by its use, reference should be made to the drawings and accompanying descriptive matter, in which there is illustrated and described a preferred embodiment of the invention.

BRIEF DESCRIPTION OF THE DRAWINGS

In the Drawings, which form a part of the instant specification and are to be read therewith, an optimum embodiment of the invention is shown, and, in the various views, like numerals are employed to indicate like parts.

DETAILED DESCRIPTION OF THE PREFERRED EMBODIMENT

Figure 1:
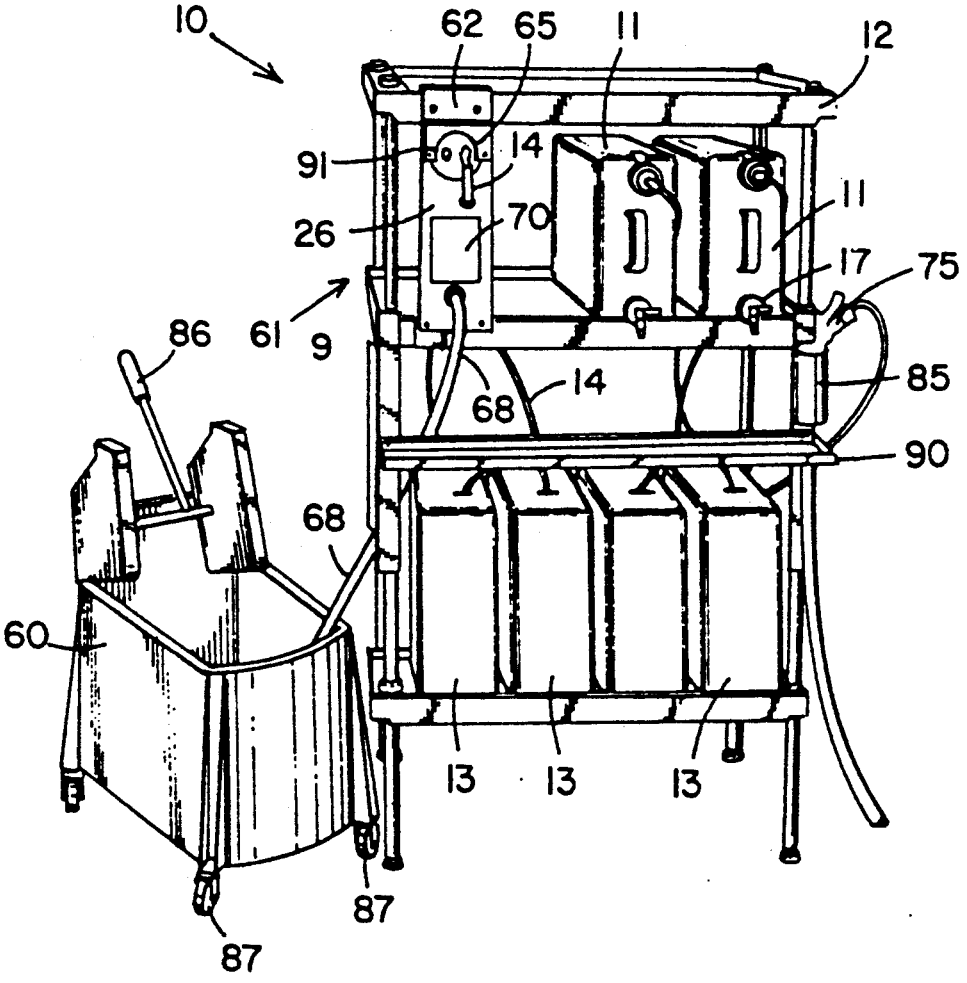
FIG. 1 is a perspective view of the dilution and dispensing system of the present invention.

Referring to FIG. 1, the system for diluting, storing and dispensing solutions is shown generally at 10. The system 10 is preferably supported by a rack or cart 12 which may be supported on wheels (not shown) so as to allow the cart assembly to be moved as necessary after disconnection from the water supply line. The system 10 includes one or more containers 13 for the concentrated solution which, for example, may be concentrated cleaning products. The rack 12 may support one or more containers or jugs 11 which store diluted cleaning product. The jugs 11 have a spigot 17 which can be opened for filling spray bottles (not shown) which are supported upon a shelf 90. The jugs 11 are preferably approximately three to five gallons in size.

For filling relatively large containers such as the mop bucket 60 shown in FIG. 1, an aspirator assembly 61 is employed. The aspirator assembly 61 is shown in more detail in FIGS. 3 and 4. The aspirator assembly 61 includes proportioning means, preferably an aspirator 26, which is surrounded by a housing 67. The proportioning means could also be an electric or mechanical pump. The aspirator assembly 61 is mounted upon a barrier means such as a plate 62, and the plate 62 mounts to the rack 12 by means of a lip 63 along its upper edge and by a plurality of screws 64. Preferably, the plate 62 is made of a metal material. A housing 67 surrounds the aspirator 26 and elbow 71, and is also preferably made of a metal material.

The aspirator assembly 61 has a port 65 for receiving a product inlet tube 14. The conduit 14 carries the concentrated liquid from a container 13 to the aspirator assembly 61. The conduit is preferably made of a flexible plastic material which is clear or translucent, such as polyvinyl chloride. The conduit 14 passes through an aperture 66 and bushing 88 in the plate 62 and is connected at its lower end to one of the concentrate containers 13 by means of a threaded connection.

In the preferred embodiment, the product pick-up tube 14 is approximately three-eighths of an inch in diameter and is less than approximately ten feet in length. These dimensions allow for adequate aspirator efficiency, and a larger tube diameter would allow for a longer pick-up tube 14 to be utilized. A minimum flow pressure of approximately 40 psi must be provided by the water source.

The pick-up tubing 14 is preferably translucent, so that the user can verify when it is filled with concentrate 15 and can view the metering tip 82, discussed below. It is desirable for the pick-up tube 14 to be completely filled and not contain air. The lower end of the pick-up tube 14 has a check valve (not shown), such as an umbrella check valve.

In the preferred embodiment, the aspirator plate 62 is provided with a label 70 which may contain information regarding the corresponding concentrated product.

A water inlet port 91 accommodates the water inlet supply hose 16. Both the concentrate port 65 and water inlet port 91 are positioned at the front of the aspirator assembly's plate 62, and both are in fluid communication with the aspirator 26, which is located behind the plate 62 in the preferred embodiment.

In the aspirator 26, the vacuum created by the flow of water is utilized to withdraw the proper proportion of concentrated cleaning solution from its container 13. In this manner, the water and concentrate enter the discharge tube 68 simultaneously. The water and concentrate pass through the aspirator 26, and the aspirator's output fills the product use container 11. In the preferred embodiment, the aspirator 26 is made of a suitable plastic material such as high density polyethylene.

The aspirator assembly 61 has a water tube and a concentrate tube 14, both tubes leading into the aspirator 26. The aspirator 26 is in fluid communication with a discharge tube 68. An elbow 71 is provided between the outlet end of the aspirator and the discharge tube 68. The outlet tube 68 is attached to the elbow 71 by means of a clamp 90 or other suitable connection means. The discharge tube 68 extends proximate the bottom of the container 60. This allows for underwater dispensing to minimize foaming. The container 60 as illustrated in FIG. 1 is a mop bucket, and the mop bucket 60 has a handle 86 and wheels 87 to facilitate transporting the mop bucket to the point of usage.

In the preferred embodiment, the discharge tube 68 is translucent or clear so that the user can view the solution as it passes into the mop bucket 60. With the present invention, the dispensing of the diluted solution is at a rate of approximately three to four gallons per minute, and the mop bucket 60 is filled in approximately one to two minutes. In the preferred embodiment, the discharge tube is made of a flexible, chemical-resistant material such as polyvinyl chloride, and it is approximately one inch in diameter.

Figure 2:
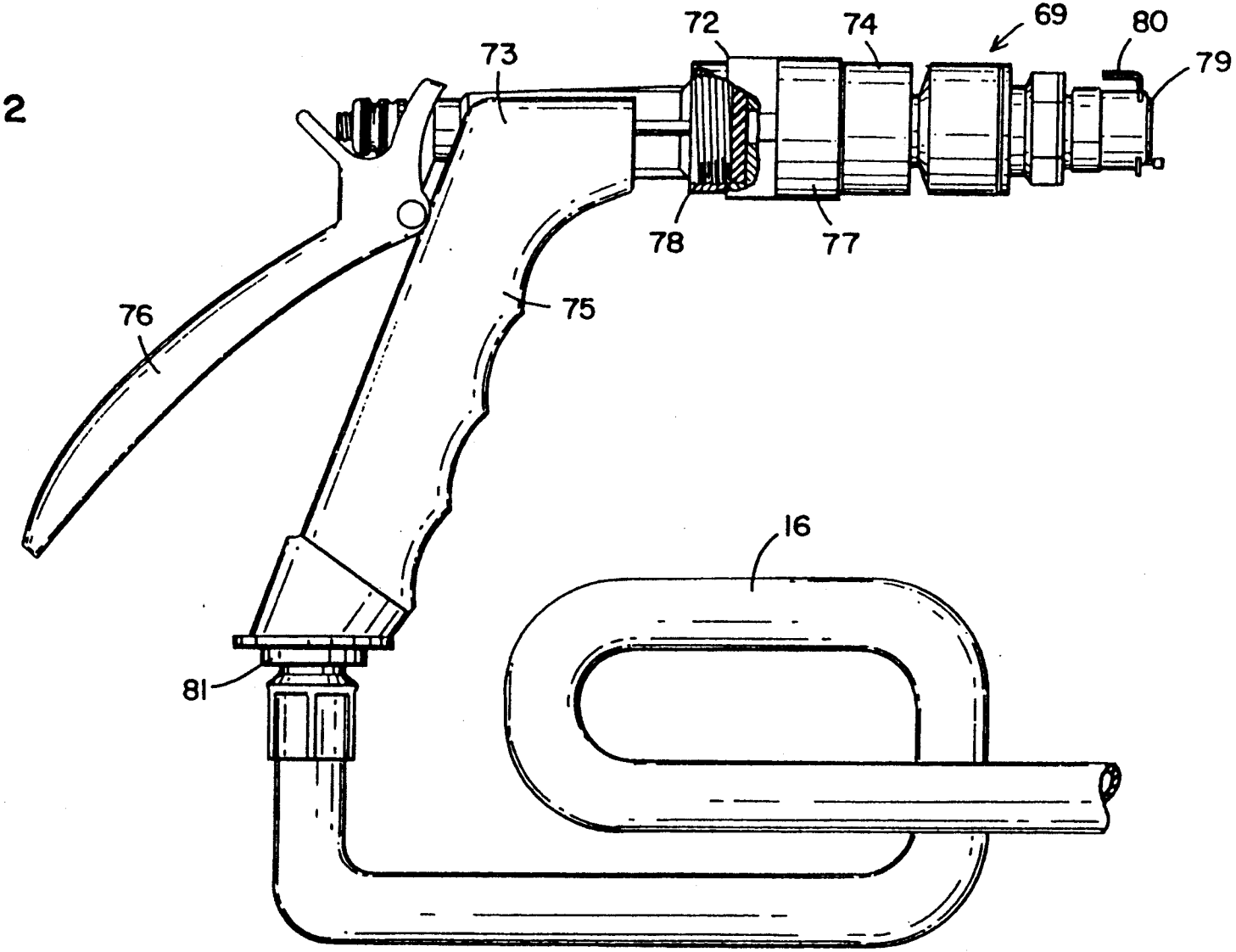
FIG. 2 is a side view of the water supply assembly of the present invention, partially cutaway.

A water supply assembly 69 is illustrated in FIG. 2. The water supply assembly 69 includes a water supply line 16 which is interconnected to faucet (not shown) or other water supply device. The water hose 16 is approximately six feet in length. In the preferred embodiment, the water is activated by a suitable water supply valve. The water supply assembly 69 contains an on-off valve 73 and a backflow preventer 74. These types of devices are governed by the requirements of local plumbing codes. In the preferred embodiment, the water gun 69 is held by a holder 85 mounted upon the rack when the water gun 69 is not in use, as illustrated in FIG. 1.

Preferably, the valve 73 is contained within a handle portion 75 of the water supply assembly. The valve 73 is opened by lowering an actuator such as a lever 76, which is lowered as the user grasps the handle portion 75. The lever 76 is spring-loaded so that it is biased in a manner such that the valve is normally closed. The barrel portion 77 of the water supply assembly 69 is interconnected to the handle portion 75 by means of a threaded connection 78 and a gasket 72, as shown in the cutaway portion of FIG. 2. The end of the barrel 77 is a quick connect fitting 79 which is sized and configured to correspond to the size of the water inlet port 91. The water supply fitting 79 has a release button 80, the depression of which allows for quick connection and disconnection of the water supply fitting 79 to the water inlet port 91. In the preferred embodiment, the handle's lower portion is interconnected to the water supply hose 16 by a threaded connection 81.

Although only one aspirator assembly 26 is mounted upon the rack 12 shown in FIG. 1, it is to be understood that multiple aspirator assemblies 26 could be mounted along the rack 12. This common situation would arise where a user employs more than one type of concentrated cleaning product 13. In this manner, the dilution and dispensing system 10 is highly flexible depending upon the particular number of cleaning products employed by the user. The aspirator assemblies 26 can be mounted either along the front of the rack 12, as shown in FIG. 1, or along one or both sides of the rack 12.

Alternatively, a single aspirator assembly could service more than one concentrate inlet line by the installation of a three-way valve proximate the inlet end of the aspirator 26. The valve (not shown) could be switched to the desired concentrate line as necessary and would be mounted to the plate 62. It is also possible to disconnect a pick-up tube 14 and connect another pick-up tube 14 when a different concentrate is to be diluted.

In the preferred embodiment, the product concentrate is contained within a collapsible, bladder type package or container 13. Preferably, the concentrate bags 13 are approximately 2.5 gallons in size. The cart 12 may be sized and configured to accommodate a plurality of concentrate packages 13, as illustrated in FIG. 1. With this type of bladder bag 13, the pick-up tube 14 is simply attached to an aperture 45 in the bladder bag 13 by means of a threaded connection (not shown). A cap is provided for the bag's opening when it is not in use. With this design, the concentrate packaging 13 collapses as the concentrate is withdrawn therefrom. The packages 13 are made of any flexible material which is compatible with the chemical concentrate, such as high density polyethylene. Alternatively, a rigid container could be employed for supplying the concentrate, and the end of the pick-up tube 14 could be provided with a suitable pick-up probe and foot valve.

Examples of the types of concentrated cleaning solutions utilized with the preferred embodiment of the invention are: multi-purpose cleaners, e.g. for walls, windows, tile and hard surfaces; germicidal detergents for disinfecting and sanitizing; floor care products; and specialty products for special cleaning needs. However, it is to be understood that the present invention is not to be limited for use only with cleaning products, but can be utilized to store and dispense any type of solution.

Figure 3:
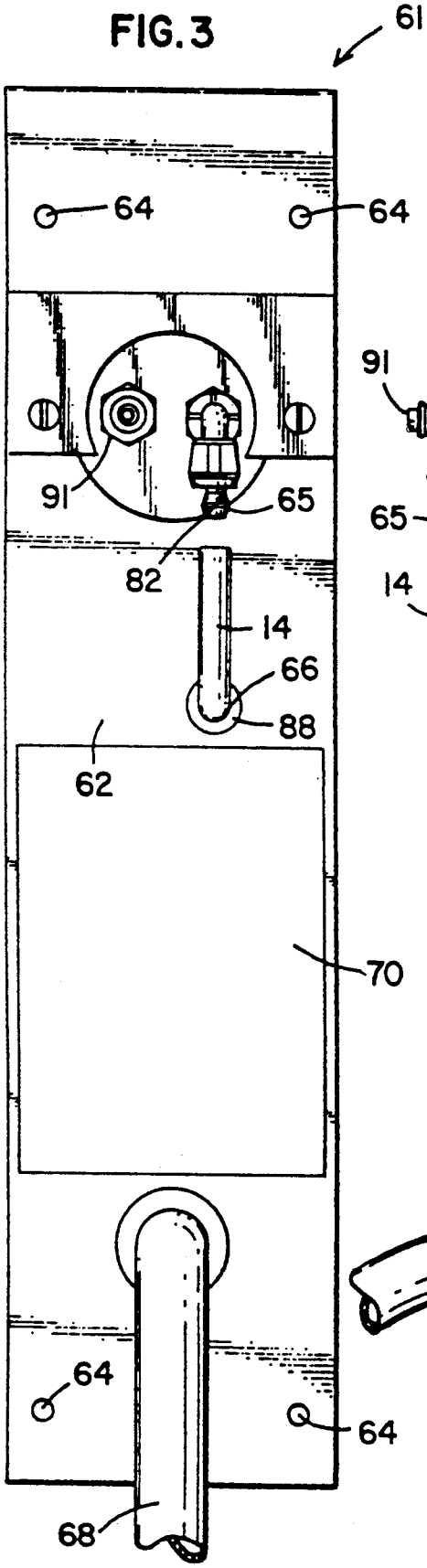
FIG. 3 is a front view of the aspirator plate assembly.
Figure 4:
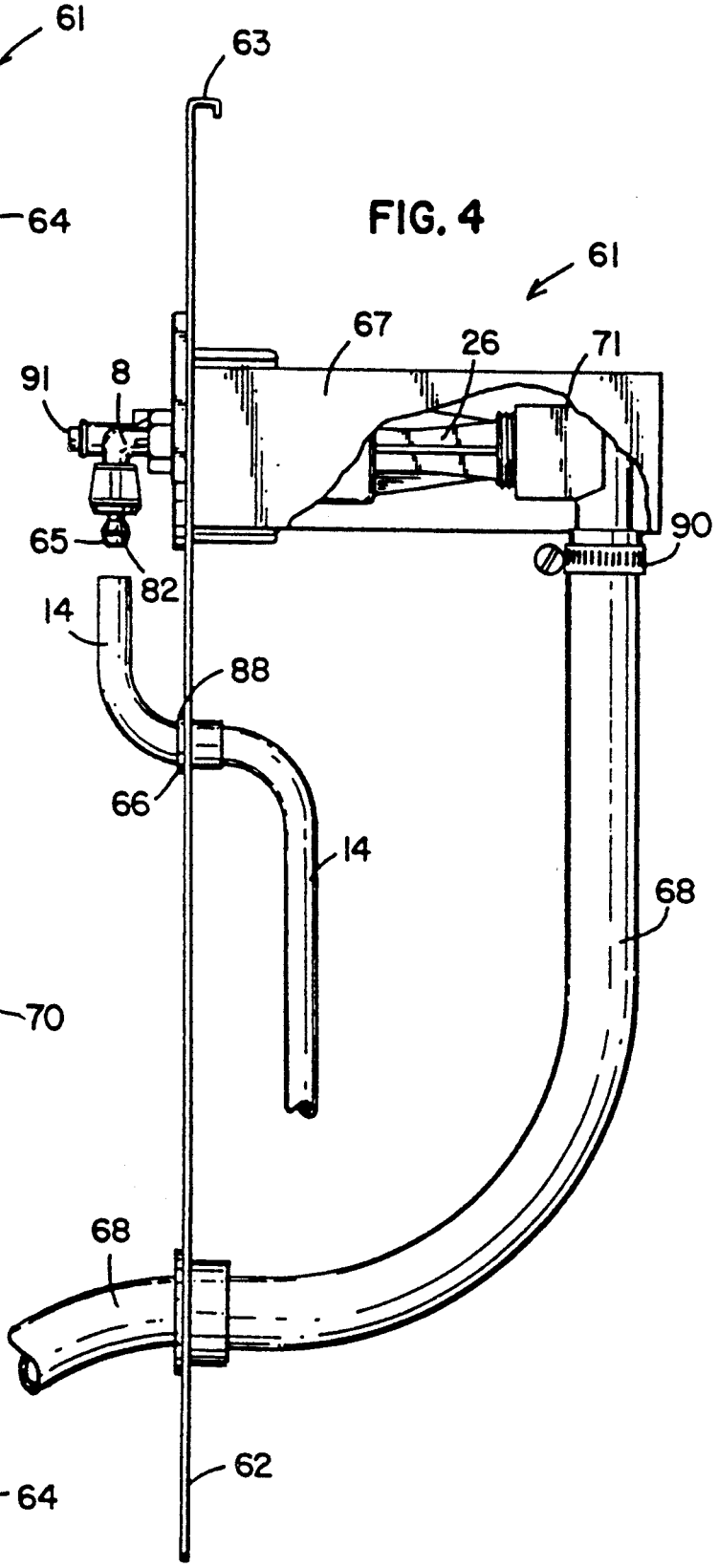
FIG. 4 is a side view of the aspirator assembly shown in FIG. 3.

The blend ratio, or proportion of chemical to water, is set by flow metering means, such as interchangeable metering tips 82 (shown in FIGS. 3 and 4). The metering tip 82 is inserted into the pick-up tube's inlet port 65, and different sized orifices of the metering tips 82 allow for different flow rates of the concentrate. Each metering tip 82 is sized and configured to correspond to a particular proportion ratio. The metering tips 82 are cylindrical in shape and approximately three-eighths of an inch in length, with the external diameter being slightly smaller than the internal diameter of the pickup tube 14, and the tip's internal diameter being governed by the desired flow rate. The metering tip's diameter may be as small as approximately 0.01 inch, with larger diameters corresponding to higher flow rates. The highest flow rate is achieved when no metering tip 82 at all is present in the pick-up tube's inlet port 65. In the preferred embodiment, the different sized metering tips have different colors and are visible to the user, so that the flow rate can be easily monitored and adjusted. This enables the user to readily determine what the dilution ratio is. Different dilution ratios are sometimes needed for different applications, e.g., one application might require a 1% solution, whereas another application may require a 10% solution of the same product. Alternatively, an adjustable metering screw may be utilized to enable the proportion ratio to be adjusted.

Another feature of the present invention is the use of identification means on the corresponding components of the system 10. Preferably, the liquid concentrate itself, the labels 9 on the concentrate packaging 13, the metering tip 82, and the aspirator assembly's label 39 are all color coded or appropriately labeled.

In operation, the user assembles the modular components by matching the colors or labels on the aspirator assembly 26 and the concentrate container 13. The pick-up tube 14 is attached to the concentrate inlet port 65 and the concentrate container 13 with suitable connections. The water inlet line 16 is attached to the water inlet port 91 via the water gun quick connector mechanism 79. The discharge hose 68 is placed within the container 60, such as a mop bucket. The water flow is initiated by activation of the water control valve, and the concentrate and water pass through the proportioning means, such as an aspirator. The rate of concentrate flow is determined by a metering tip 82 proximate the concentrate inlet port 65. When the container 60 has been filled to a desired level, the water supply assembly 69 is disconnected and the container 60 can be moved to a remote location if desired.

Even though numerous characteristics and advantages of the invention have been set forth in the foregoing description, together with the details of the structure and function of the invention, the disclosure is illustrative only, and changes may be made in detail, especially in matters of shape, size, and arrangement of parts, within the principles of the invention, to the full extent indicated by the broad, general meaning of the appended claims.

What is claimed is:

1. A dilution and dispensing apparatus, comprising:

(a) a dilution assembly having a first inlet port for a first liquid and a second inlet port for a second liquid, said inlet ports being in fluid communication with a proportioning means, said proportioning means outletting to a flexible discharge tube, said dilution assembly being mounted upon a vertical barrier means;

(b) a first inlet line for supplying said first liquid, said first inlet line being in fluid communication with a gun assembly which is removably interconnected to said first inlet port, said gun assembly having a flow actuator and a valve;

(c) a second inlet line for supplying said second liquid, said second inlet line being removably interconnected to said second inlet port and to a source of said second liquid, wherein said barrier means includes an aperture for said discharge tube and an aperture for said second inlet line.

2. The dilution and dispensing apparatus according to claim 1, wherein said first liquid is water.

3. The dilution and dispensing apparatus according to claim 2, wherein said proportioning means comprises an aspirator.

4. The dilution and dispensing apparatus of claim 3, wherein said gun assembly includes a backflow preventer.

5. A dilution and dispensing apparatus, comprising:

(a) a dilution assembly having a water inlet port and a second inlet port for a second liquid, said inlet ports being in fluid communication with an aspirator, said aspirator outletting to a discharge tube, said dilution assembly being mounted upon a plate;

(b) a first inlet line for supplying said first liquid, said first inlet line being removably interconnected to said first inlet port and to a water source, wherein said first inlet line includes a gun assembly having a valve and a backflow preventer, wherein said valve is controlled by depression of an actuator on said gun assembly; and (c) a second inlet line for supplying said second liquid, said second inlet line being removably interconnected to said inlet port and to a source of said second liquid.

6. The dilution and dispensing apparatus according to claim 4, wherein said second inlet line, said barrier means and a package for said second liquid have corresponding identification means.

7. The dilution and dispensing apparatus according to claim 6, wherein said second inlet line includes means for metering flow of said second liquid.

8. The dilution and dispensing apparatus according to claim 3, wherein said barrier means is mounted upon a cart.

9. A dilution and dispensing system comprising:

(a) a dilution assembly having a water inlet port, and a second inlet port, said inlet ports being in fluid communication with an aspirator and a flexible discharge tube, said assembly being mounted upon a vertical plate which is attachable to shelf means;

(b) a gun assembly removably interconnected to said water inlet port, said gun assembly including a valve, a backflow preventer and a water flow actuator;

(c) a concentrate inlet line for supplying a concentrate, said concentrate inlet line being removably interconnected to said second inlet port;

(d) a concentrate container for storing the concentrate, said concentrate container being positioned on said shelf means; and (e) a use container including wheel means.

10. The dilution and dispensing system according to claim 9, wherein said concentrate inlet line includes means for metering flow of the concentrate.

11. The dilution and dispensing system according to claim 10, wherein said concentrate inlet line, said plate, and packaging for said concentrate have corresponding identification means.

12. The dilution and dispensing system according to claim 9, wherein there are multiple dilution assemblies mounted upon said shell means.

13. The dilution and dispensing system according to claim 9, wherein said concentrate container is made of a collapsible material.

14. A method for diluting, storing and handline liquid solutions, comprising the steps of:

(a) interconnecting a water inlet line to a water inlet port, said water inlet line having a flow actuator and valve which are proximate said water inlet port;

(b) interconnecting a pick-up tube to a concentrate inlet port at one end and to a concentrate container at an opposite, second end of said pick-up tube, said water inlet port and said concentrate inlet port being in fluid communication with an aspirator;

(c) activating water flow by depressing said flow actuator and thereby withdrawing concentrate from said concentrate container via said aspirator;

(d) outletting diluted use solution to a use container; and (e) moving said use container to a point of usage.

15. The method for storing and handling solutions according to claim 14, further comprising the step of disconnecting said pick-up tube from said concentrate inlet port and connecting another pick-up tube to said concentrate inlet port.

* * * * *